US007066324B2

(12) United States Patent
Yin et al.

(10) Patent No.: US 7,066,324 B2
(45) Date of Patent: Jun. 27, 2006

(54) SANITARY CIGARETTE CASE

(75) Inventors: Zhiyong Yin, Tieling (CN); Qingfeng Li, Beijing (CN)

(73) Assignee: Yongxi Weng, Beijing (CN)

( * ) Notice: Subject to any disclaimer, the term of this patent is extended or adjusted under 35 U.S.C. 154(b) by 161 days.

(21) Appl. No.: 10/478,156

(22) PCT Filed: May 25, 2001

(86) PCT No.: PCT/CN01/00864

§ 371 (c)(1),
(2), (4) Date: Nov. 19, 2003

(87) PCT Pub. No.: WO02/094687

PCT Pub. Date: Nov. 28, 2002

(65) Prior Publication Data

US 2005/0061689 A1 Mar. 24, 2005

(51) Int. Cl.
*B65D 85/10* (2006.01)

(52) U.S. Cl. ..... 206/254; 206/268; 206/273

(58) Field of Classification Search ..... 206/249, 206/254, 265, 268, 271, 273, 817; 229/101, 229/101.1, 160.1
See application file for complete search history.

(56) References Cited

U.S. PATENT DOCUMENTS 2,258,170 A * 10/1941 Austin et al. ..... 205/254
2,320,289 A * 5/1943 Marx ..... 229/160.1
2,407,415 A * 9/1946 Graziano ..... 229/101
2,812,057 A * 11/1957 Brownfield ..... 206/254
3,107,008 A * 10/1963 Margulies ..... 206/249
3,212,689 A * 10/1965 Woolfolk ..... 206/254
4,570,790 A * 2/1986 Turnage ..... 206/268
4,607,748 A * 8/1986 Focke ..... 206/254
4,709,811 A * 12/1987 Shimada ..... 206/254
6,435,342 B1 * 8/2002 Agnes ..... 206/268
6,450,329 B1 * 9/2002 Draghetti et al. ..... 206/255
6,726,006 B1 * 4/2004 Funderburk et al. ..... 206/268

* cited by examiner

*Primary Examiner*—Luan K. Bui
(74) *Attorney, Agent, or Firm*—Perkins Coie, LLP

(57) ABSTRACT

A package for cigarettes, including a sanitary cigarette case which can avoid filter tips from being contacted by fingers, so preventing germs on the fingers from spreading into the mouth via the filter tips. The case can include a case body and a case cover and an opening surface of the case body that is parallel with the longitudinal axis of cigarettes. The opening end of the case body can be covered by the case cover, which has a concavity in its longer face. An advantage of this cigarette case is that it is designed so that person can grasp the middle of a cigarette when they remove the cigarette from the cigarette case, thereby preventing the filter tips from being contacted by the fingers, and preventing germs on the fingers from spreading into the mouth via the filter tips. This cigarette case can have a sanitary, convenient, elegant operation, simple manufacturing process and low cost.

3 Claims, 2 Drawing Sheets

SANITARY CIGARETTE CASE

TECHNICAL FIELD

The present invention relates to sanitary cigarette packages, including a sanitary cigarette case which can avoid filter tips of cigarettes therein from being contacted by fingers so as to prevent germs on the fingers from spreading into the mouth through the filter tips.

BACKGROUND

At present, the known high-grade cigarette package is generally a chipboard cigarette case with the cover turned up, which generally accommodates twenty cigarettes. There are also cases for accommodating nine, ten, sixteen etc. cigarettes. An opening is provided at the short side of the rectangular cigarette case, with the opening surface disposed transversely to the longitudinal axis of the cigarettes. A defect of this kind of cigarette case (which has been used for many years) is that the cigarette is taken out from the cigarette case by holding the filter tip with the hand. The filter tip, having contacted the fingers, is then contacted with the user's lips while smoking, which leads to germs on the fingers spreading into the mouth via the filter tip, making the unhealthy smoking habit more unsanitary. Sometimes, the smoker will invite another person to take the cigarette by grasping the filter tip. This is not only unsanitary but also increases the potential infecting sources of illness, and may be awkward. The function of the filter tip is for filtering the substances in the cigarette harmful to the human body in order to protect peoples' health, but the existing cigarette case structure causes the filter tip to be a medium for introducing harmful substances into the human body. In order to avoid this occurrence, some smokers would prefer to remove the cigarette by grasping the end with exposed tobacco leaf (e.g., by opening the bottom of the cigarette case instead of taking the cigarette from the top opening). Although this method is more sanitary, it is easy to make the tobacco leaf loose by grasping the end at which the tobacco leaf is exposed, and the cigarette is may fall out, thus affecting the appearance of the cigarette case and the cigarette quality. Furthermore, this operation is cumbersome.

SUMMARY

One aspect of the present invention is to provide a sanitary, convenient package structure, which can allow people to grasp only the middle portion of a cigarette when they pick the cigarette out of the cigarette case, thus not only avoiding unsanitary contact associated with taking the cigarette tip, but also avoiding losing cigarette leaf associated with taking the end at which the cigarette leaf is exposed. Aspects of this cigarette case also have a simple structure and convenient, elegant operation.

Unlike the prior art, aspects of this invention include a sanitary cigarette case, which can prevent people's fingers from contacting cigarette filter tips, thus preventing germs on the fingers from spreading into the mouth via the filter tip.

A purpose of the present invention can be realized by the following technical scheme: a case body and a case cover with an opening surface of the case body being parallel with a longitudinal axis of the cigarettes, the opening surface of the case body being covered by the case cover and having an opening thereon. There can also be provided a recess in a surface (e.g., a "long side surface of the opening") of the case body in which a long side of the opening surface lies.

Further technical features of embodiments of the present invention include a case cover that is connected with the case body integrally and can be turned up. The case can include a notch at a surface (e.g., a "short side surface of the opening") of the case body in which a short side of the opening surface lies for taking cigarettes out conveniently, and a section of a closing surface at an end of the case opening surface opposed to the notch. A recess can be formed by perforated lines (which can be easy to tear) on the case body, and a plurality of perforated lines can be disposed along the longitudinal direction of the recess. The length of the recess is long enough for removing the cigarettes within the case. An elastic sheet may be disposed at the opposite side of the case opening surface, or the case can include a pulling strip for holding cigarettes from the bottom of the case, with one end of the pulling strip adhered to an inner upper end of the case, while the other end thereof extends to the opening opposite the adhered position at the upper end of the case body. An inner lining can be disposed within the case body, with the recess at the long side surface of the opening being formed on the inner lining. The notch can be disposed on the inner lining at the short side surface of the case opening for convenient removal of the cigarettes. A protruded part of the inner lining can be folded onto another protruded part of the inner lining to form the section of closing surface at one end of the long side surface of the case opening. One end of the elastic sheet can be attached between the inner lining and the inner surface of the case body. The elastic sheet can be formed by a hard sheet under which a spring is disposed.

ADVANTAGES

The advantages of aspects of the present invention include providing a sanitary cigarette case, which can allow people to avoid finger contact with the filter tip of the cigarettes, thus preventing germs on the fingers from spreading into the mouth via the filter tip. The cigarette case can have a simple structure and a convenient, elegant operation.

BRIEF DESCRIPTION OF THE DRAWINGS

The detailed description of the present invention makes reference to the accompanying drawings in connection with embodiments of the invention, in which.

Figure 1:
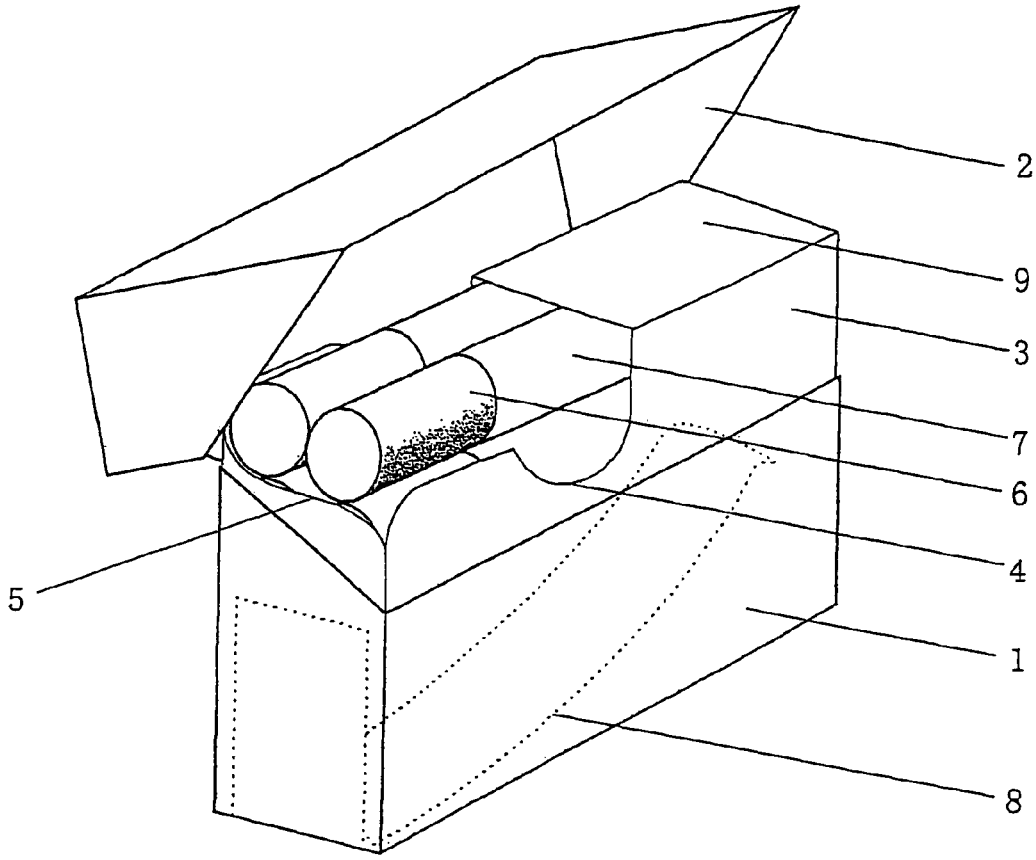
FIG. 1 is a schematic structural view of an embodiment of the present invention.
Figure 2:
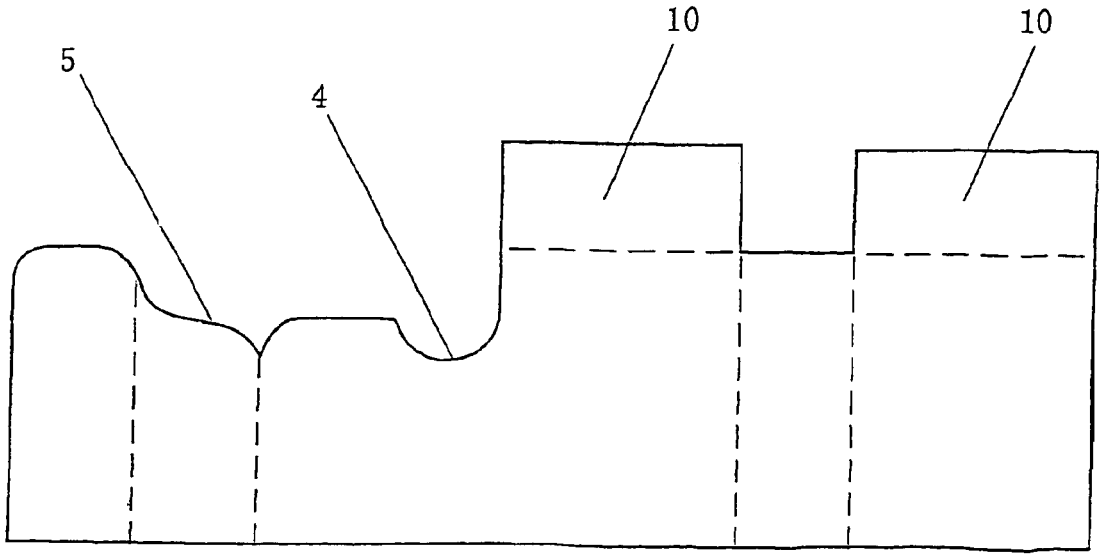
FIG. 2 is a schematic view showing the inner lining shape in accordance with an embodiment of the present invention.
Figure 3:
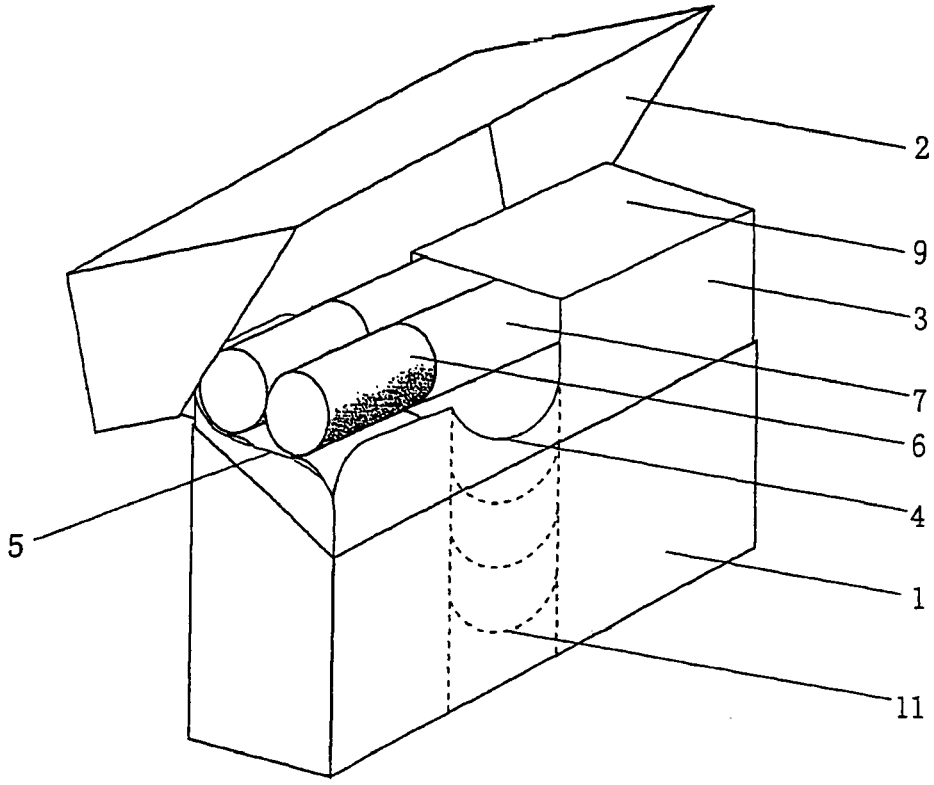
FIG. 3 is a schematic view showing the long recess formed by the perforating lines provided at the case body.
Figure 4:
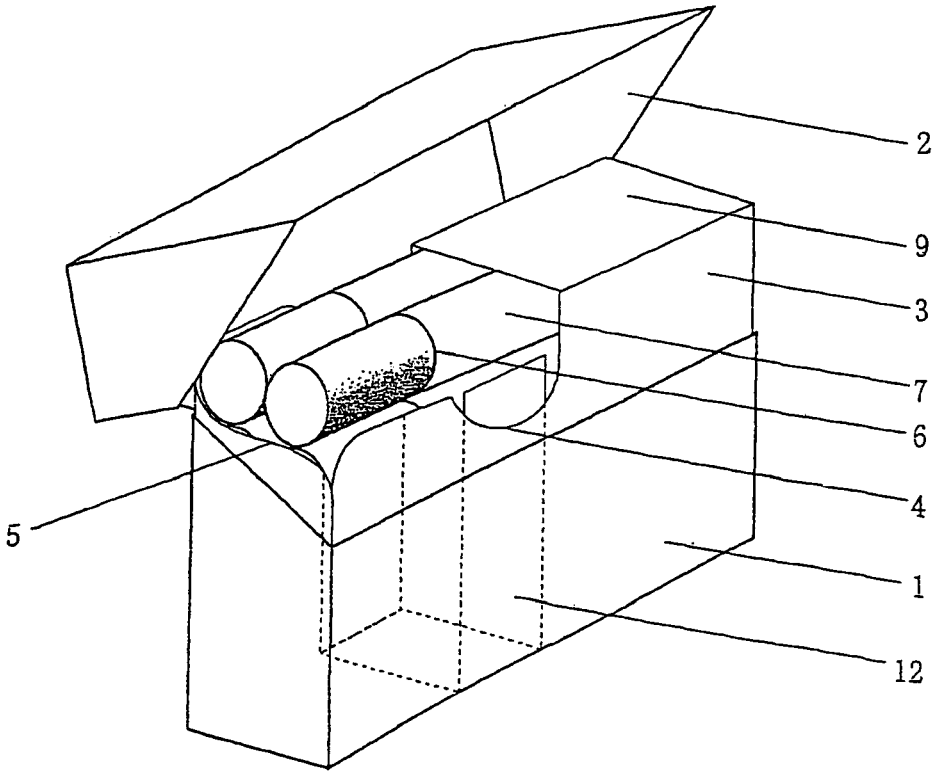
FIG. 4 is a structural schematic view showing the formed pulling strip at the bottom of the case body.

| | | | |
|---|---|---|---|
| 1 | case body | 2 | case cover |
| 3 | inner lining | 4 | recess |
| 5 | notch | 6 | filter tip |
| 7 | cigarette | 8 | elastic sheet |
| 9 | closing surface | 10 | protruded part |
| 11 | perforating line | 12 | pulling strip |

DETAILED DESCRIPTION OF EMBODIMENTS OF THE INVENTION

A case in accordance with an embodiment of the present invention includes a case body 1, and a case cover 2. The case body 1 and the case cover 2 can be formed integrally, and also can be formed separately. An opening surface of the case body 1 is disposed parallels to the longitudinal axis of the cigarettes in the cigarette case. Accordingly, the cigarettes are disposed transversely at the opening of the case, which can make it easier for a user to hold the middle portion of the cigarettes. The case cover 2 covers the opening surface of the case body.

A recess 4 can be disposed at a surface (e.g., a long side surface) of the opening in which a long side of the opening surface lies. In one embodiment, it is preferable to dispose the recess 4 at the middle portion of the long side of the opening surface. Disposing the recess at the long side can make it easier for the user to hold the cigarette at the recess with the fingers and remove the cigarettes. When a longer recess is needed, a multi-stage tearing arrangement can be to used to extend the recess, making it easier to remove all the cigarettes from the case. The surface of the recess 4 can be coated with thin paper, with one end of the thin paper connected to one side of the recess and joined to the recess surface for covering the recess, or the recess 4 can be formed by perforated lines (which are easy to tear) on the case body 1. For example, a plurality of parallel perforated lines can be disposed along a longitudinal direction of the recess 4. The corresponding covering part can be torn along the perforated lines, depending on the position being of the cigarette to be withdrawn. Accordingly, the length of the recess 4 can be selectively lengthened to conveniently take out all the cigarettes within the case.

When the case cover 2 is connected with the case body 1 integrally, the case cover 2 can be turned up. In one embodiment, there is a notch 5 at another surface (e.g., a short side surface of the opening) of the case body 1 for taking cigarettes out conveniently. A short side of the opening surface lies in the above short side surface. The area of the notch 5 can be a slightly larger than the sectional area of the cigarette, or a larger notch 5 can be formed by cutting out a part of the upper end of the short side of the opening surface. The case can also include a section of a closing surface 9 at the opening surface of the case body, within which the cigarette exposed ends are disposed. This arrangement can not only protect the cigarette exposed ends, but can also prevent the cigarettes from spilling out of the case, for example, when the cigarettes at the bottom of the case are removed by inverting the case.

In addition, when an elastic sheet or pulling strip is disposed at the opposite side of the case opening surface, it can prevent cigarettes from being ejected or pulled out en masse. For example, an elastic sheet 8 can be disposed at the opposite side (e.g., the bottom of the case body) of the opening of the case body 1, which can push the cigarettes at the lower layer to the upper layer at the opening. In another embodiment, a pulling strip 12 holds cigarettes from bottom of the case body 1, with one end of the pulling strip adhered to the inner upper end of the case body, while the other end extends to the opening opposite of the adhered position at the upper end of the case body. This arrangement allows the user to hold the pulling strip at the opening and take the cigarettes out.

The inner lining 3 is disposed within the case body for enhancing the strength of the case body. The inner lining 3 can include an overlap part being formed by the inner lining at the upper of the case body 1 and the case cover 2, which can hold cigarettes within the case while opening the case. When the case cover and the case body are formed integrally, the recess 4 at the long side surface of the opening can be formed on the inner lining 3 and a notch can be disposed on the inner lining 3 (for convenient removal of the cigarettes) at the short side surface of the case opening and can extend to the edge of the recess at the long side of the inner lining. A protruded part 10 of the inner lining can be folded onto another protruded part of the inner lining to form the section of the closing surface 9 at the one end of the long side of the case body. The one end of the elastic sheet 8 can be attached between the inner lining 3 and the inner surface of the case body 1. The elastic sheet 8 can be formed by a hard sheet under which a spring is disposed, with the spring fixed at the bottom of the case body, and the cigarettes disposed on the hard sheet.

Aspects of the present invention provide a sanitary cigarette case, which can allow people to avoid finger contact with the filter tip of the cigarettes, thus preventing germs on the fingers from spreading into the mouth via the filter tip. Further aspects of this cigarette case include a simple structure and a convenient, elegant operation. The scope of the present invention is not limited to the above embodiments, and any equivalent modifications of the present invention are also included within the scope of present invention. Accordingly, the invention is not limited except as by the appended claims.

The invention claimed is:

1. A cigarette case, comprising:

a generally rectangular case body;

an inner lining disposed within the case body and having a first surface, a second surface generally parallel with the first surface, a third surface connecting the first surface and the second surface, and a closing surface connecting the first surface and the second surface, wherein an opening is positioned between the first, second, third, and closing surfaces, and wherein at least a part of a recess is located in a middle portion of at least one of the first surface and the second surface, the recess being adjacent to the opening, the recess being offset longitudinally from the third surface, and wherein a notch is disposed on the inner lining at the third surface;

a side surface opposite the case opening;

an elastic sheet disposed at the side surface, wherein one end of the elastic sheet is attached between the inner lining and the inner surface of the case body, the elastic sheet being formed by a hard sheet under which a spring is disposed; and a case cover configured to cover the opening.

2. The cigarette case according to claim 1, wherein a protruded part of the inner lining is folded onto another protruded part of the inner lining to form the closing surface.

3. The cigarette case of claim 1, further comprising a pulling strip for holding cigarettes, positioned toward the bottom of the case, one end of the pulling strip being adhered to an inner upper end of the case, while the other end thereof extends to the opening at the opposite side surface of the case body.

* * * * *